US005991567A

United States Patent [19]

Kobayashi et al.

[11] Patent Number: 5,991,567

[45] Date of Patent: Nov. 23, 1999

[54] IMAGE FORMING APPARATUS WITH INTERMEDIATE TRANSFER MEMBER CLEANING

[75] Inventors: Tatsuya Kobayashi, Soka; Takehiko Suzuki, Numazu; Takaaki Tsuruya, Mishima, all of Japan

[73] Assignee: Canon Kabushiki Kaisha, Tokyo, Japan

[21] Appl. No.: 09/034,242

[22] Filed: Mar. 4, 1998

[30] Foreign Application Priority Data

Mar. 4, 1997 [JP] Japan ..... 9-049281
Feb. 27, 1998 [JP] Japan ..... 10-047005

[51] Int. Cl.[6] ..... G03G 15/01; G03G 21/00

[52] U.S. Cl. ..... 399/101; 399/302

[58] Field of Search ..... 399/101, 302, 399/308

[56] References Cited

U.S. PATENT DOCUMENTS 5,099,286 3/1992 Nishise et al. ..... 399/302
5,457,487 10/1995 Sakaki et al. ..... 347/116
5,722,015 2/1998 Tombs ..... 399/129

*Primary Examiner*—Joan Pendegrass
*Attorney, Agent, or Firm*—Fitzpatrick, Cella, Harper & Scinto

[57] ABSTRACT

The present invention provides an image forming apparatus in which, after secondary transferring, secondary transferring residual toner remaining on an intermediate transfer member can be cleaned effectively. A cleaning roller 5*g* is contacted with an intermediate transfer belt 5*a* and bias is applied from a power source 5*h* to the cleaning roller 5*g*, thereby charging secondary transferring residual toner remaining on the intermediate transfer belt 5*a* with polarity opposite to normal polarity of toner in a developing means 4. In this case, a rectangular wave of alternate voltage having a duty ratio of 50% or more is used as the bias. Whereby, the secondary transferring residual toner can be charged uniformly, the cleaning ability for the secondary transferring residual toner can be improved.

28 Claims, 6 Drawing Sheets

FIG. 3

| COMPARED SAMPLE (DIRECT CURRENT BIAS) | CLEANING CHARACTER | TRANSFER CHARACTER IN CONTINUOUS PRINTING |
|---|---|---|
| + 500 V | × | ○ |
| + 1000 V | △ | ○ |
| + 1500 V | ○ | × |
| EMBODIMENT | ○ | ○ |

FIG. 6

| COMPARED SAMPLE (DIRECT CURRENT BIAS) | TONER CHARGE AMOUNT (μC/g) |
|---|---|
| + 500 V | -10 |
| + 1000 V | + 5 |
| + 1500 V | + 25 |

| DUTY | TONER CHARGE AMOUNT (μC/g) |
|---|---|
| 50% | -10 |
| 60% | +10 |
| 70% | +15 |
| 80% | +20 |
| 90% | +25 |
| 95% | +5 |

IMAGE FORMING APPARATUS WITH INTERMEDIATE TRANSFER MEMBER CLEANING

BACKGROUND OF THE INVENTION

1. Field of the Invention

The present invention relates to an electrophotographic image forming apparatus particularly suitable for using as a copying machine, a laser beam printer or the like.

2. Related Background Art

FIG. 7 schematically shows a conventional image forming apparatus. Incidentally, the image forming apparatus shown in FIG. 7 is a laser beam printer having four developing devices which can selectively be switched and an intermediate transfer belt as an intermediate transfer member.

In the image forming apparatus shown in FIG. 7, a surface of a photosensitive drum 1 rotated in a direction shown by the arrow R1 is uniformly charged by a charge roller (charger) 2, and an electrostatic latent image corresponding to an yellow image is formed by illuminating a laser beam from an exposure device 3 having a light source and a mirror. By rotating a rotary 4*a* of a developing means 4 in a direction shown by the arrow R4, a developing device 4Y corresponding to yellow is brought to a developing position D where the developing device 4Y is opposed to the photosensitive drum 1. In the developing position D, yellow toner is adhered to the electrostatic latent image on the photosensitive drum 1, thereby forming an yellow toner image. The yellow toner image is first-transferred onto an intermediate transfer belt (intermediate transfer member) 5*a*. The intermediate transfer belt 5*a* is mounted around rollers 5*b*, 5*c* and 5*d* and is rotatingly driven in a direction shown by the arrow R5, and the yellow toner image on the photosensitive drum 1 first-transferred onto the intermediate transfer belt 5*a* at first transfer nip $T_1$ by applying predetermined first transfer bias to a first transfer roller 5*e*. After the first transferring of the toner image, first transferring residual toner remaining on the photosensitive drum 1 is removed by the cleaner 6, thereby preparing for next magenta image formation.

The series of processes effected regarding the yellow toner (i.e., charging, exposure, developing, first transferring and cleaning) are performed regarding magenta toner, cyan toner and black toner (other than the yellow toner), four color toner images are superimposed on the intermediate transfer belt 5*a*. The four color toner images are collectively secondary-transferred onto a transfer material P such as a paper sheet at a secondary transfer nip $T_2$ while the transfer material P supplied from a sheet supply cassette (not shown) by a sheet supply roller (not shown) is being conveyed between a secondary transfer roller 5*f* (rotated in a direction shown by the arrow Kf) and the intermediate transfer belt 5*a*, by applying secondary transfer bias to the secondary transfer roller 5*f*. After the secondary transferring, the transfer material P is sent, by a convey belt (not shown), to a fixing device 7, where the toner images are fixed to the transfer material by heat and pressure. In this way, image formation is finished. On the other hand, after the secondary transferring, secondary transferring residual toner remaining on the intermediate transfer belt 5*a* is removed by a cleaner 5*g*, thereby preparing for next first transferring.

Now, the cleaning of the intermediate transfer belt 5*a* will be explained. The cleaning roller 5*g* is constituted by a metal core, a base layer coated on the metal core and having a thickness of 2 to 6 mm and made of rubber having resistance of $10^4$ to $10^6$ Ω.cm, and a surface layer having a thickness of 50 to 300 μm and made of rubber or resin having resistance of $10^6$ to $10^{12}$ Ω.cm. The cleaning roller 5*g* can be shifted (in a direction shown by the arrow Kg) toward and away from the intermediate transfer belt 5*a* by a drive means (not shown). When the toner images on the photosensitive drum 1 are successively first-transferred onto the intermediate transfer belt 5*a*, the cleaning roller 5*g* is disengaged from the intermediate transfer belt 5*a*, and, after the toner images on the intermediate transfer belt 5*a* are secondary-transferred onto the transfer material P, the cleaning roller 5*g* is engaged with the intermediate transfer belt 5*a*. In this condition, bias is applied from a bias power source 5*i* to the cleaning roller 5*g*. Briefly explaining a cleaning method used herein, the secondary transferring residual toner remaining on the intermediate transfer belt 5*a* is charged with polarity opposite to normal charging polarity of the toner of the developing means 4 by the cleaning roller 5*g* to which the direct current bias was applied and is transferred from the intermediate transfer belt 5*a* onto the photosensitive drum 1 at the first transfer nip $T_1$, thereby cleaning the surface of the intermediate transfer belt 5*a*. The secondary transferring residual toner transferred to the photosensitive drum is also removed by the cleaner 6 (for the photosensitive drum 1) for removing first transferring residual toner.

However, in the above-mentioned conventional technique, particularly when a four full-color image is formed, since an amount of the secondary transferring residual toner on the intermediate transfer belt 5*a* is increased, the secondary transferring residual toner cannot be charged adequately with opposite polarity by the cleaning roller 5*g*, thereby arising a problem that cleaning ability is worsened. Further, when images are continuously formed, there arises a problem that the poor cleaning affects a bad influence upon a next image. On the other hand, if a value of the bias applied to the cleaning roller 5*g* is increased, the secondary transferring residual toner can be charged adequately. In this case, however, the intermediate transfer belt 5*a* is charged excessively, with the result that, when the images are continuously formed on a plurality of transfer materials P, the first transferring ability regarding second and other transfer materials P is worsened.

In the above description, while an example that the intermediate transfer belt 5*a* is used as the intermediate transfer member was explained, if intermediate transfer drum is used, the similar problems will arise.

SUMMARY OF THE INVENTION

An object of the present invention is to provide an image forming apparatus in which residual toner remaining on an intermediate transfer member can be charged uniformly.

Another object of the present invention is to provide an image forming apparatus in which residual toner remaining on an intermediate transfer member can be cleaned effectively and through-put of continuous image formation can be improved.

BRIEF DESCRIPTION OF THE DRAWINGS

FIG. 3 is an explanatory view showing comparison between a cleaning character and a transferring character;

FIG. 6 is an explanatory view showing a relation between cleaning bias and a charge amount of secondary transferring residual toner.

DETAILED DESCRIPTION OF THE PREFERRED EMBODIMENTS

The present invention will now be explained in connection with embodiments thereof with reference to the accompanying drawings.

<First Embodiment>

Figure 1:
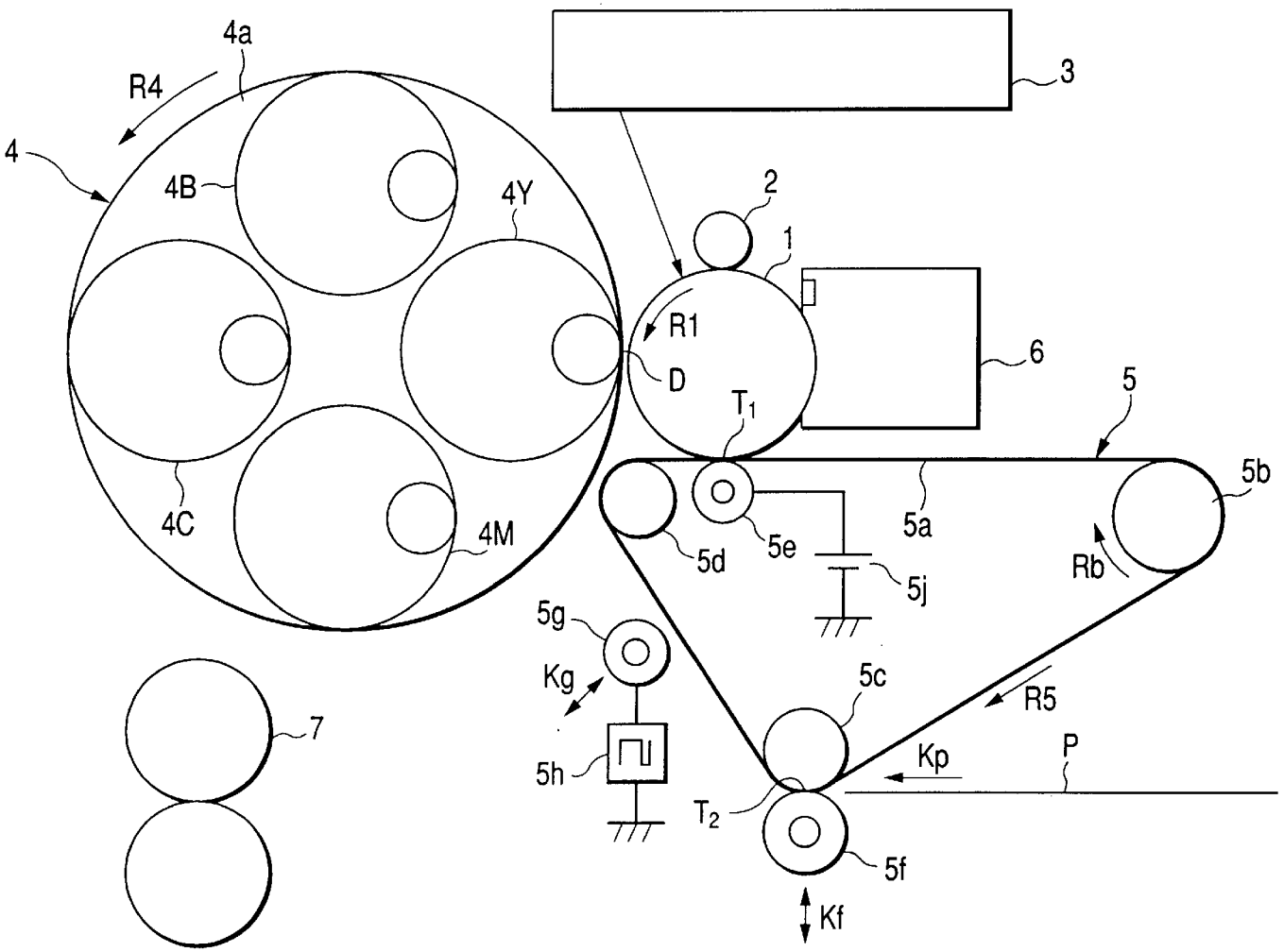
FIG. 1 is a schematic elevational sectional of an image forming apparatus according to the present invention.

FIG. 1 schematically shows an example of an image forming apparatus (electrophotographic four full-color laser beam printer) according to the present invention.

First of all, a construction and image forming process of the image forming apparatus will be briefly described with reference to the accompanying drawings. In the following explanation, an example that an yellow (Y) color toner image, a magenta (M) color toner image, a cyan (C) color toner image and a black (B) color toner image are successively formed in order by using toner (charged negative polarity) in a developing means 4 thereby to obtain a four full-color image will be described. Of course, in this image forming apparatus, a mono-color image can also be formed, and the number of colors can be selected appropriately in accordance with an original.

The image forming apparatus shown in FIG. 1 includes an electrophotographic drum-shaped photosensitive member (referred to as "photosensitive drum" hereinafter) 1. The photosensitive drum 1 has a cylindrical drum substrate made of conductive aluminium and a photosensitive body (photosensitive layer) formed on a peripheral surface of the drum substrate. The photosensitive body may be, for example, photoconductor such as OPC (organic photosemiconductor), A—Si (amorphous silicon), CdS (cadmium sulfide) or Se (selenium).

The photosensitive drum 1 is rotatably supported by a body (not shown) of the image forming apparatus and is rotated in a direction shown by the arrow R1 at a predetermined process speed by a drive means (not shown). The photosensitive drum 1 is uniformly charged with predetermined polarity and predetermined potential by applying charge bias to a charge roller (charger) 2 (contacted with the photosensitive drum 1) from a charge power source (not shown).

After the charging, an electrostatic latent image is formed on the surface of the photosensitive drum 1 by an exposure device 3. The exposure device 3 includes a light source, a polygon mirror, a lens and a reflection mirror (all of them are not shown), and, by scanning the surface of the photosensitive drum 1 by a laser beam generated in response to an yellow image signal, the electrostatic latent image corresponding to yellow (first color) is formed. The electrostatic latent image is developed by a developing means 4. The developing means 4 includes four developing devices (i.e., developing device 4Y containing yellow toner, developing device 4M containing magenta toner, developing device 4C containing cyan toner and developing device 4B containing black toner), and, by rotating a rotary 4*a,* a selected developing device to develop the electrostatic latent image on the photosensitive drum 1 (yellow developing device 4Y in FIG. 1) is brought to a developing position D where the developing device is opposed to the photosensitive drum 1. The yellow developing device 4Y positioned at the developing position D develops the electrostatic latent image on the photosensitive drum 1 as an yellow toner image by adhering the yellow toner to the electrostatic latent image.

The yellow toner image is first-transferred onto an intermediate transfer belt (intermediate transfer member) of a transfer device 5. The intermediate transfer belt 5*a* is formed from a rubber sheet made of EPDM (ethylene-propylene rubber), NBR (nitrile rubber), urethane or silicone rubber, or a flexible resin sheet made of PVdF (polyvinylidene fluoride) or PET (polyethylene terephthalate). The belt 5*a* is mounted around a drive roller 5*b,* a driven roller 5*c* and a tension roller 5*d* and is rotatingly driven (shifted) in a direction shown by the arrow R5 by rotating the drive roller 5*b* in a direction (clockwise direction) shown by the arrow by means of a drive means (not shown). Inside the intermediate transfer belt 5*a,* there is disposed a first transfer roller 5*e* which cooperates with the photosensitive drum 1 to pinch the intermediate transfer belt 5*a* therebetween to thereby form a first transfer nip (first transfer position) $T_1$ between the first transfer roller and the intermediate transfer belt 5*a*. A voltage apply means comprises the first transfer roller 5*e* and a high voltage power source 5*j,* and predetermined first transfer bias having polarity opposite to the normal polarity of the toner (positive polarity bias in the illustrated embodiment) is applied from the high voltage power source 5*j* to the first transfer roller 5*e,* with the result that the yellow toner image on the photosensitive drum 1 is first-transferred onto the intermediate transfer belt 5*a*. After the transferring of the toner, first transferring residual toner remaining on the surface of the photosensitive drum 1 is removed by a cleaner (cleaning means) 6, thereby preparing for next magenta image formation.

The series of processes effected regarding the yellow toner (i.e., charging, exposure, developing, first transferring and cleaning) are performed regarding the other three colors (magenta, cyan and black), four color toner images are successively superimposed on the intermediate transfer belt 5*a*. Incidentally, when the four color toner images are first-transferred, the first transfer bias applied to the first transfer roller 5*e* is successively increased by tens of volts to hundreds of volts every color.

Thereafter, the four color toner images on the intermediate transfer belt 5*a* are transferred onto a transfer material P such as a paper sheet. Outside the intermediate transfer belt 5*a,* there is disposed a secondary transfer roller 5*f* which cooperates with the driven roller 5*c* to pinch the intermediate transfer belt 5*a* therebetween to thereby form a secondary transfer nip $T_2$ between the secondary transfer roller 5*f* and the intermediate transfer belt 5*a*. The transfer material P is fed from a sheet supply cassette (not shown) by a sheet supply roller (not shown) in a direction shown by the arrow Kp and is supplied to the secondary transfer nip $T_2$ in synchronous with the rotation of the intermediate transfer belt 5*a*. The four color toner images on the intermediate transfer belt 5*a* are collectively secondary-transferred onto the transfer material P supplied to the secondary transfer nip $T_2$, by applying predetermined secondary transfer bias having polarity opposite to the normal polarity of the toner (positive polarity bias in the illustrated embodiment) from a high voltage power source (not shown) to the secondary transfer roller 5*f*.

After the secondary transferring of the toner images on the intermediate transfer belt 5*a*, the transfer material P is sent, by a convey belt (not shown), to a fixing device 7, where the toner images are fixed to the surface of the transfer material P by heat and pressure. Thereafter, the transfer material is discharged out of the image forming apparatus. In this way, the full-color image formation is finished.

After the secondary transferring, secondary transferring residual toner remaining on the intermediate transfer belt 5*a* is charged by a cleaning roller (charge means) 5*g* (shiftable in a direction shown by the arrow Kg) to which bias was applied from a power source 5*h* and then is transferred onto the photosensitive drum 1 at the first transfer nip $T_1$. In this case, the predetermined bias having polarity opposite to the normal polarity of the toner is applied to the first transfer roller 5*e*. When the secondary transferring residual toner is charged, the cleaning roller 5*g* is contacted with the intermediate transfer belt 5*a*. Otherwise, the cleaning roller 5*g* is spaced apart from the intermediate transfer belt 5*a*. Thereafter, the intermediate transfer belt 5*a* is used for first transferring of a next toner image.

Next, the intermediate transfer belt 5*a* will be fully explained. The intermediate transfer belt 5*a* can be constituted by resin (such as PVdF, PET, polycarbonate, polyethylene or silicone) having a thickness of 50 to 200 $\mu$m and volume resistance of $10^8$ to $10^{14}$ Ω.cm. The intermediate transfer belt 5*a* may be constituted by a base layer having a thickness of 0.3 to 2 mm and volume resistance of $10^4$ to $10^8$ Ω.cm and made of urethane rubber, hydrine rubber, NBR or EPDM and a surface layer having a thickness of 2 to 100 $\mu$m and volume resistance of $10^8$ to $10^{14}$ Ω.cm and made of rubber or resin such as PVdF, PET, polycarbonate, polyethylene or silicone. Since the volume resistance of the base layer as conductor is set to be low ($10^4$ to $10^8$ Ω.cm), the entire base layer of the intermediate transfer belt 5*a* becomes first transferring potential. When the intermediate transfer belt is constituted by the rubber base layer and the surface layer, as mentioned above, since the volume resistance of the rubber base layer is set to be low ($10^4$ to $10^8$ Ω.cm), the entire rubber base layer of the intermediate transfer belt 5*a* becomes first transferring potential.

Next, the cleaning of the intermediate transfer belt 5*a* will be described.

The cleaning roller 5*g* is constituted by a metal core, a base layer coated on the metal core and having a thickness of 2 to 6 mm and made of rubber having resistance of $10^4$ to $10^6$ Ω.cm, and a surface layer having a thickness of 50 to 300 $\mu$m and made of rubber or resin having resistance of $10^6$ to $10^{12}$ Ω.cm. The cleaning roller 5*g* can be shifted (In a direction shown by the arrow Kg) toward and away from the intermediate transfer belt 5*a* by a drive means (not shown). When the toner images on the photosensitive drum 1 are successively first-transferred onto the intermediate transfer belt 5*a*, the cleaning roller 5*g* is disengaged from the intermediate transfer belt 5*a*. After the secondary transferring regarding the intermediate transfer belt 5*a*, the cleaning roller 5*g* is engaged with the intermediate transfer belt 5*a*. In this condition, secondary transfer bias is applied from a bias power source 5*h* to the cleaning roller 5*g*. When the secondary transferring residual toner is charged, the cleaning roller 5*g* may not be contacted with the intermediate transfer belt 5*a*. However, it is more preferable that the cleaning roller 5*g* is contacted with the intermediate transfer belt 5*a*, because the apply bias can be reduced. In this way, the secondary transferring residual toner on the intermediate transfer belt 5*a* is charged with polarity opposite to the normal polarity of the toner of the developing means 4 and is conveyed to the first transfer nip $T_1$.

The secondary transferring residual toner conveyed to the first transfer nip $T_1$ is transferred onto the photosensitive drum 1 by applying the predetermined bias to the first transfer roller 5*e*. Further, at the first transfer nip $T_1$, by using the first transfer roller 5*e*, at the same time when the yellow toner image (first color image) on the photosensitive drum 1 is first-transferred onto the intermediate transfer belt 5*a*, the secondary transferring residual toner on the intermediate transfer belt 5*a* is transferred onto the photosensitive drum 1. In this way, the through-put during the continuous image formation can be improved. The secondary transferring residual toner transferred to the photosensitive drum 1 is removed by the cleaner 6, similar to the first transferring residual toner.

Next, the characteristic portions of the present invention will be explained.

Figure 2A:
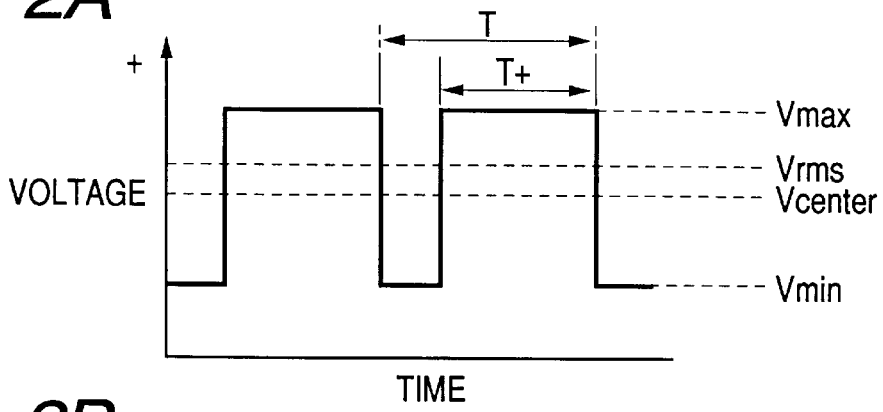
FIG. 2A is an explanatory view showing a rectangular wave as asymmetrical alternate voltage having different duty.
Figure 2B:
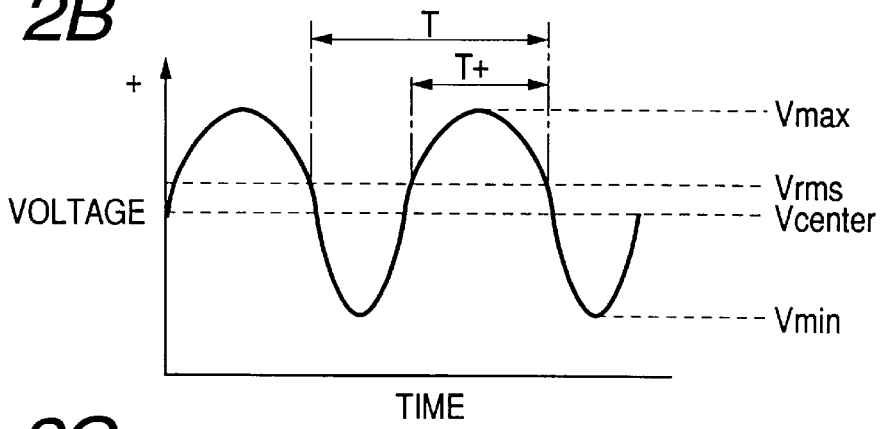
FIG. 2B is an explanatory view showing a wave obtained by mixing two sine waves as asymmetrical alternate voltage having different duty.
Figure 2C:
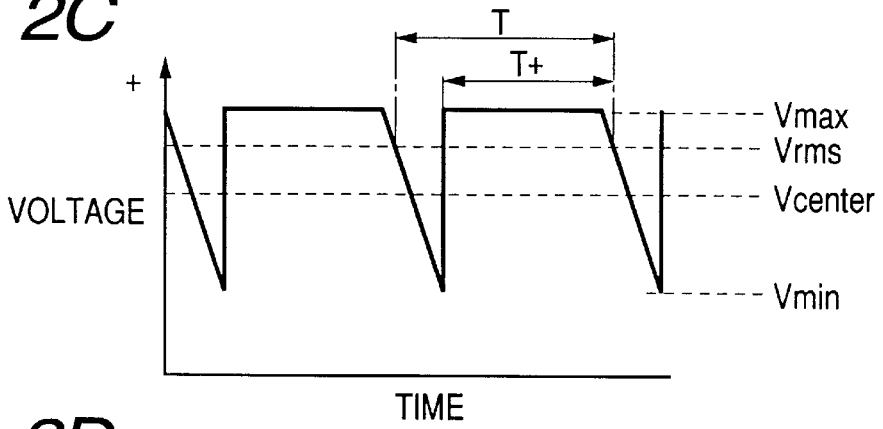
FIG. 2C is an explanatory view showing a triangular pulse wave as asymmetrical alternate voltage having different duty.
Figure 2D:
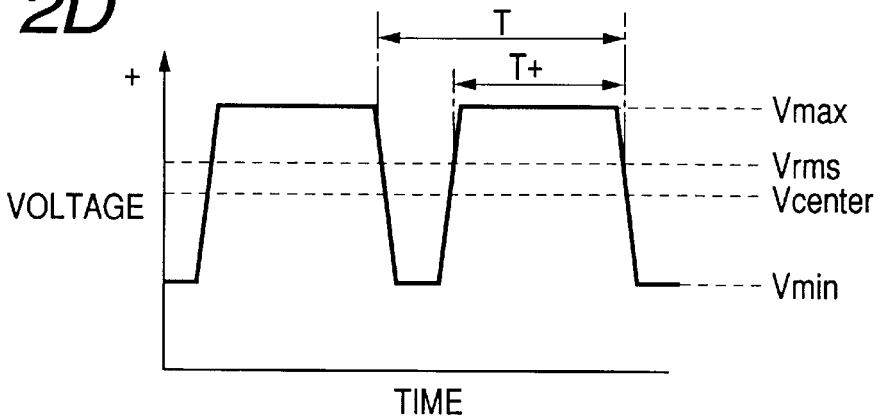
FIG. 2D is an explanatory view showing a trapezoidal pulse wave as asymmetrical alternate voltage having different duty.

In FIG. 1, the reference numeral 5*h* denotes a high voltage power source for applying the bias to the cleaning roller 5*g*. The characteristic of the present invention is that asymmetrical alternate electric field is used as the bias. The asymmetrical alternate electric field is an electric field generated when asymmetrical alternate voltage (such as a wave form having different duty ratio as shown in FIG. 2A or a wave form obtained by combining two sine waves having frequencies different at plus and minus sides of voltage as shown in FIG. 2B or a triangular pulse wave form as shown in FIG. 2C or a trapezoidal pulse wave form as shown in FIG. 2D) is applied. In FIGS. 2A to 2D, "Vmax" indicates a maximum value of voltage, "Vmin" indicates a minimum value of voltage, "Vcenter" indicates an average value between the maximum value Vmax and the minimum value Vmin, and "Vrms" indicates root-means-square. It is designed so that, by applying the asymmetrical alternate voltage, the root-means-square Vrms is deviated from the average value Vcenter (deviated toward the plus side in FIGS. 2A to 2D). Regarding the wave forms shown in FIGS. 2A to 2D, it is set so that a time period T+ in which the voltage is plus exceeds 50% of one cycle T.

FIG. 3 shows cleaning character, and, transfer stability character (in the continuous image formation) in a compared sample in which only direct current bias is applied to the cleaning roller 5*g* and the embodiment of the present invention in which bias having the rectangular wave form (as shown in FIG. 2A) having maximum voltage value Vmax of +1500V, minimum voltage value Vmin of −1500V, amplitude potential (peak-to-peak voltage) Vpp of 3000V (difference in potential between the maximum voltage value Vmax and the minimum voltage value Vmin), duty ratio of 70% and frequency of 3 kHz is applied to the cleaning roller. Incidentally, the duty ratio is represented as ratio of time period T+ (longer time period among Vmax and Vmin) in which the respective wave forms as shown in FIGS. 2A to 2D (referred to as "bias waves" hereinafter) exist in the root-means-square Vrms side, with respect to the cycle T.

As apparent from FIG. 3, in the compared sample, regarding the bias value of +500V, although a surface portion of the secondary transferring residual toner was returned to the photosensitive drum 1 and was cleaned, a bottom portion of the secondary transferring residual toner near the intermediate transfer belt 5*a* was not returned to the photosensitive drum 1 and caused the poor cleaning regarding the next image (shown by a symbol "x"). On the other hand, in the continuous image formation, the second image was first-transferred effectively (shown by a symbol "○"). In the bias value of +1000V, regarding the cleaning character, although two color superimposed portions (Y+M, M+C, Y+C) were cleaned effectively, the poor cleaning was generated in a three color superimposed portion (Y+M+C) (shown by a symbol "Δ"). On the other hand, second and other images in the continuous image formation were first-transferred effectively. Next, regarding the bias value of +1500V, the three color superimposed portion was cleaned effectively (shown by a symbol "○"). On the other hand, regarding the second and other images in the continuous image formation, particularly first color Y first transferring was worsened to change color. The reason is that, since the bias applied to the cleaning roller 5*g* is great (+1500V), the intermediate transfer belt 5*a* is charged not to satisfy the optimum condition for the first color Y of the next image.

In comparison with the compared sample, in the embodiment of the present invention, regarding the cleaning character, the three color superimposed portion was cleaned effectively, and the second and other images in the continuous image formation were first-transferred effectively.

In this way, the reason (in which the present invention has excellent cleaning character and transfer stability in the continuous image formation) is, firstly, that the bias applied from the high voltage power source 5*h* to the cleaning roller 5*g* is the alternate voltage and the alternate electric field is generated by the alternate voltage between the cleaning roller 5*g* and the intermediate transfer belt 5*a*. By charging the secondary transferring residual toner on the intermediate transfer belt 5*a* by using the alternate electric field, the secondary transferring residual toner on the intermediate transfer belt 5*a* is agitated, with the result that the bottom portion of the secondary transferring residual toner can also be charged uniformly. Secondly, the reason is that the secondary transferring residual toner can be charged with polarity opposite to the normal polarity of the toner in the developing means 4 without charging the intermediate transfer belt 5*a* is not charged excessively.

Figure 4:
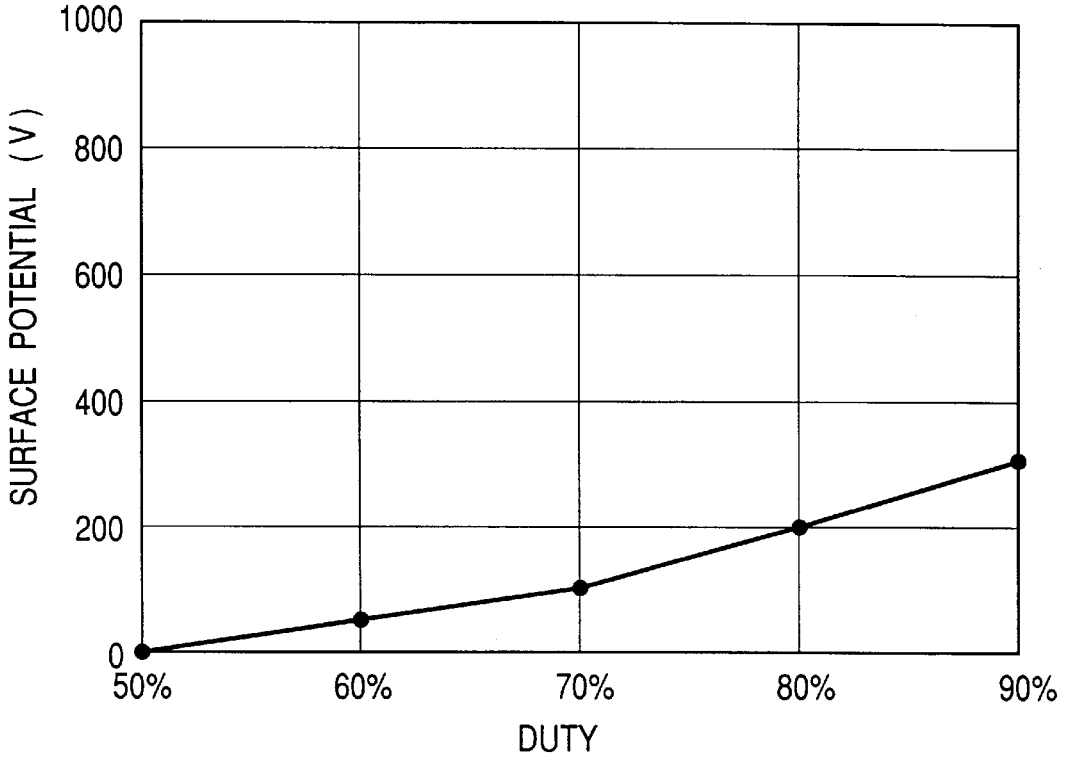
FIG. 4 is an explanatory view showing a relation between duty and surface potential of an intermediate transfer belt.

Then, the surface potential of the intermediate transfer belt 5*a* given by the cleaning roller 5*g* and the charge amount of the secondary transferring residual toner after passed through the cleaning roller 5*g* were checked while changing the duty of the bias applied to the cleaning roller 5*g*. FIG. 4 shows a relation between the duty ratio and the surface potential of the intermediate transfer belt 5*a*. As apparent from FIG. 4, in the duty ratio of 50% (symmetrical bias), the surface potential of the intermediate transfer belt 5*a* was zero, and, thus, the electricity was completely removed from the surface of the intermediate transfer belt 5*a*. Further, the surface potential was gradually increased as the duty ratio was increased, with the result that, in the duty ratio of 90%, the surface potential became +300V. On the other hand, the surface potential obtained when only the direct current is applied (in the compared sample) became 0V (at +500V), +500V (at +1000V) and +1000V (at +1500V).

Figure 5:
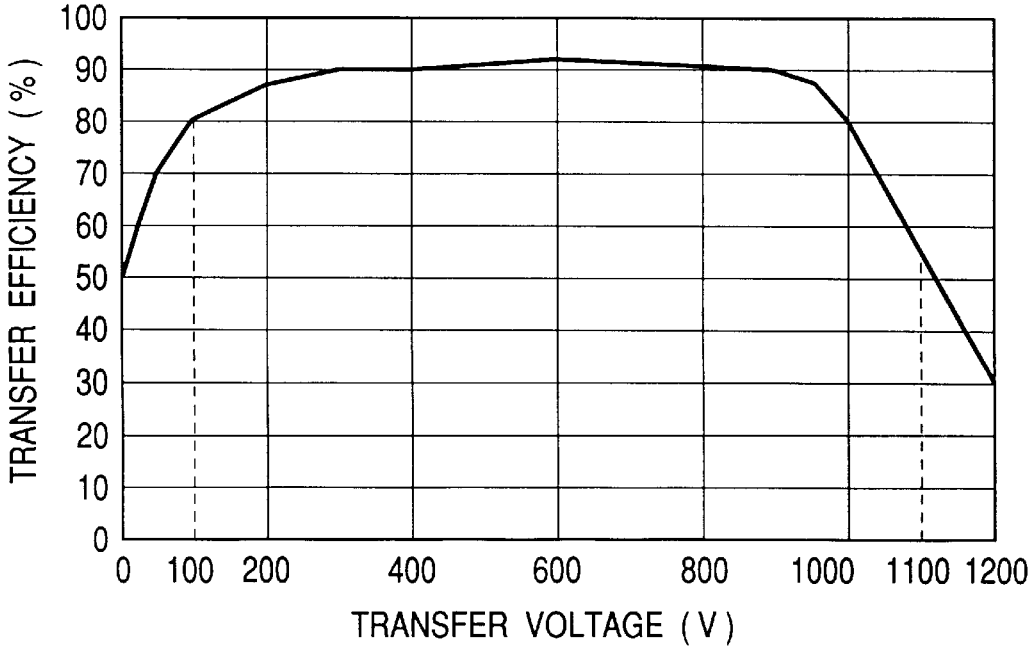
FIG. 5 is an explanatory view showing a relation between first transfer voltage (first transfer bias) and transferring efficiency.
Figure 7:
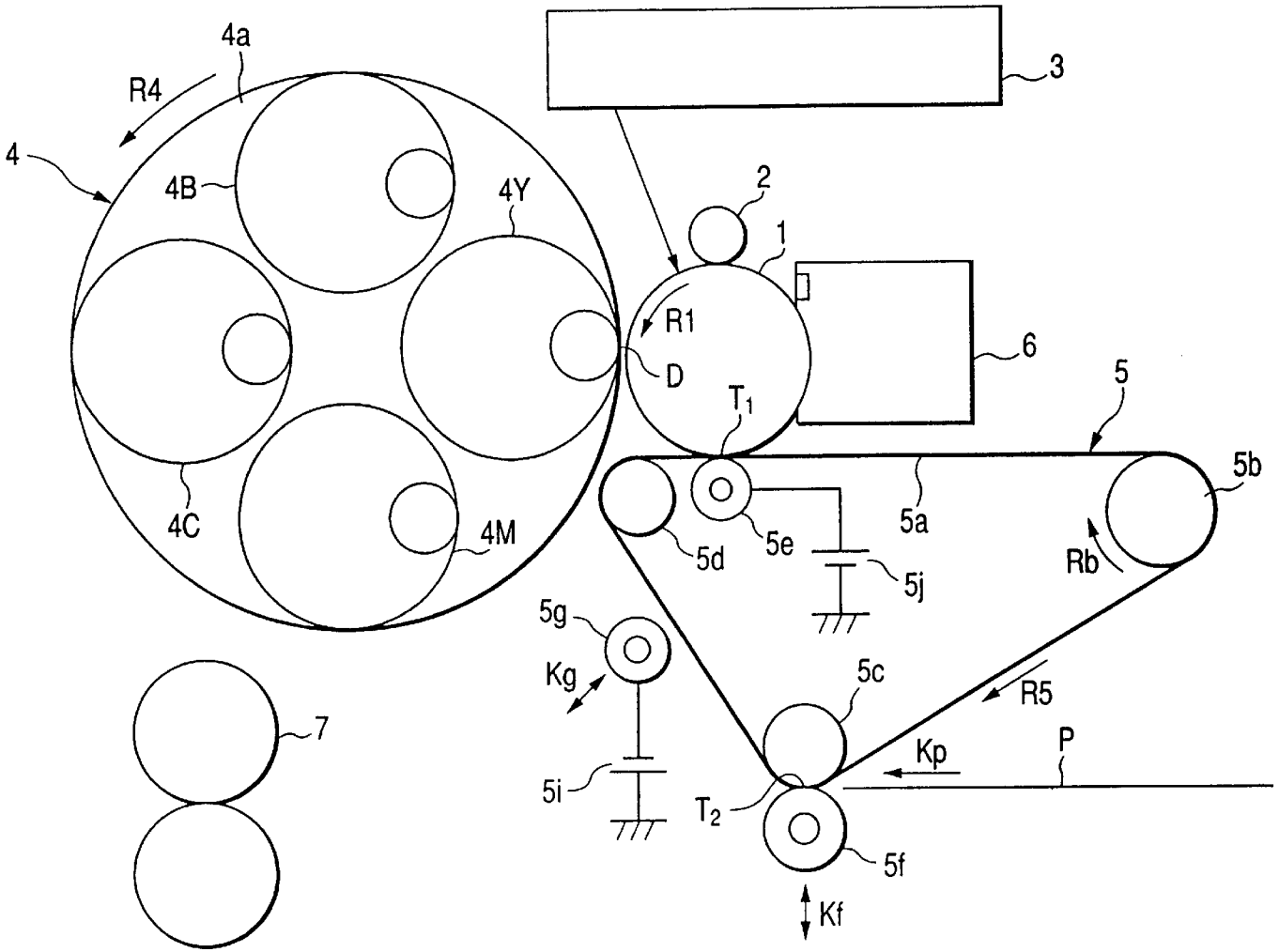
FIG. 7 PRIOR ART
FIG. 7 is a schematic elevational sectional view of a conventional image forming apparatus.

FIG. 5 shows the first transferring efficiency of the toner image from the photosensitive drum 1 to the intermediate transfer belt 5*a* when the first transfer bias applied to the first transfer roller 5*e* is changed. If the first transfer bias exceeds 1000V, the first transferring efficiency is worsened abruptly. It is considered that the reason is that, since the first transfer bias is too great, before the toner image on the photosensitive drum 1 is first-transferred, discharge is generated between the photosensitive drum 1 and the intermediate transfer belt 5*a* to charge the toner with opposite polarity. In the actual first transferring, a value obtained by adding the charge potential generated on the intermediate transfer belt 5*a* by the cleaning roller 5*g* to the first transfer bias value for the first color of the next image becomes the first transfer bias during the first transferring. Even when the first transfer bias value is selected to voltage of +100V (minimum value in which the first transfer efficiency exceeds 80%), if the direct current of +1500V is applied to the first transfer roller 5*e* (as is in the compared sample), since the surface potential of the intermediate transfer belt 5*a* after passed through the cleaning roller 5*g* is +1000V, the actual first transfer bias becomes +1100V and the transfer efficiency becomes 55%, resulting in the poor transferring. To the contrary, in the illustrated embodiment, even in the duty ratio of 90%, the surface potential of the intermediate transfer belt 5*a* is +300V (refer to FIG. 4), and, even when the first transfer bias of +100V is added, the total potential becomes +400V and the transfer efficiency becomes 90%, thereby establishing good first transferring.

FIG. 6 shows the charge amount of the secondary transferring residual toner after passed through the cleaning roller 5*g*.

When only the direct current was applied as is in the compared sample shown in FIG. 3, the charge amount was −10 μC/g (at bias of +500V), +5 μC/g ( at bias of +1000V) and +25 μC/g (at bias of +1500V). On the other hand, when the alternate voltage was applied as is in the illustrated embodiment, in the duty ratio of 50%, the toner charge amount after passed through the cleaning roller 5*g* was −10 μC/g which is the same as the toner charge amount before passing through the cleaning roller 5*g*. In the duty ratio of 60%, the toner charge amount became +10 μC/g, in the duty ratio of 70%, the toner charge amount became +15 μC/g, in the duty ratio of 80%, the toner charge amount became +20 μC/g, and, in the duty ratio of 90%, the toner charge amount became +25 μC/g. Thus, in case of the duty ratio of 60% or more in which the secondary transferring residual toner is changed to the plus (positive) polarity, the secondary transferring residual toner was transferred onto the photosensitive drum 1 effectively. However, if the duty ratio exceeds 90%, the charge amount of the toner was decreased to +5 μC/g, thereby worsening the cleaning character (transfer character to the photosensitive drum 1). The reason is that the toner cannot follow the alternate electric field not to charge the bottom portion of the residual toner adequately by the agitating action. Accordingly, the duty ratio of 60 to 90% is preferable. Further, due to the property of the high voltage power source, in consideration of frequency property and stability of the duty ratio (the frequency property must be improved as the duty ratio is increased), by selecting the duty ratio to 70 to 85%, a cheap high voltage power source can be used.

As mentioned above, by applying the asymmetrical bias having the duty ratio of 60 to 90% to the cleaning roller 5*g*, the secondary transferring residual toner can be charged with opposite polarity without charging the intermediate transfer belt 5*a* excessively, with the result that the good cleaning character (transfer character to the photosensitive drum 1) and the stability of the first transferring in the continuous image formation are compatible. The reason is considered as follows.

That is to say, the charges shifted from the cleaning roller 5*g* to the intermediate transfer belt 5*a* and the secondary transferring residual toner is divided into two (charges generated by spatial discharge, and charges charged at the nip between the cleaning roller 5*g* and the intermediate transfer belt 5*a*). Regarding the intermediate transfer belt 5*a,* since the change in charge potential is small even if the duty ratio is changed, when mainly charged by the spatial discharge, the intermediate transfer belt is charged quickly as the polarity of the bias is changed. And, since the intermediate transfer belt is charged through the entire period in which Vmax and Vmin are applied, the charge potential is not changed to kept constant (Vcenter) even if the duty ratio is changed. To the contrary, since the charge amount of the secondary transferring residual toner is changed if the duty ratio is changed, it is considered that the secondary transferring residual toner is subjected to the charges mainly generated by the charging at the nip. In case of the charging, since the charging is effected through the entire period in which Vmax and Vmin are applied, the charge amount depends upon the time period in which Vmax and Vmin are applied.

Next, the cleaning ability was checked while changing Vpp (|Vmax−Vmin|). It was found that the above-mentioned effect is obtained when Vpp is 1000V or more, but, if Vpp is too high, withstand voltage of the surface layers of the intermediate transfer belt 5*a* and the cleaning roller 5*g* is exceeded, thereby causing the leak. Thus, in dependence upon the intermediate transfer belt 5*a* and the cleaning roller 5*g,* it is preferable that Vpp of 8 kV or less is used. In this case, it is preferable that AC current is 0.5 to 5 mA. Further, in consideration of change in resistances of the intermediate transfer belt 5*a* and the cleaning roller 5*g,* the AC current is preferably 1 to 3 mA. Incidentally, the measurement of the AC current can be attained by connecting know resistance (1 kΩ) between the ground and the high voltage power source and by measuring a terminal-to-terminal voltage value of the known resistance when voltage is applied to the cleaning roller 5*g.* In this case, since the measurement becomes unstable if the measurement is performed at the high voltage output side, the measurement is preferable at the ground side of the high voltage power source.

Then, when the frequency was changed, it was found that, in the frequency of 500 Hz or less, the charge cycle pattern is generated on the image. When the frequency exceeds 5 kHz, the toner charge amount was decreased to worsen the cleaning character (transfer character of the secondary transferring residual toner to the photosensitive drum 1). The reason is that the toner cannot follow the alternate electric field not to charge the bottom portion of the residual toner adequately by the agitating action. Accordingly, it is preferable that the frequency is selected to 500 to 5000 Hz. Further, in consideration of frequency tolerance and frequency property of the high voltage power source, when the frequency is selected to 1000 to 3000 Hz, a cheap high voltage power source can be used.

Next, when other asymmetrical bias voltages shown in FIGS. 2A to 2D were used, it was found that, regarding the duty ratio and the frequency, the same result as FIG. 2A is obtained. Further, regarding Vpp, when the trapezoidal wave form as shown in FIG. 2D was used, the same effect could be obtained at 1000V or more, but, when the sine wave form as shown in FIG. 2B and the triangular wave form as shown in FIG. 2C were used, the effect was obtained at Vpp of 1500V or more. The reason is that the time period in which Vmax and Vmin (particularly, Vmin) are applied is short.

In the above description, while an example that the toner having negative polarity is used was explained, when toner having positive polarity is used, the time period in which Vmin is applied may be longer than the time period in which Vmax is applied to obtain the same effect as the illustrated embodiment. Further, while an example that the intermediate transfer belt 5*a* is used as the intermediate transfer member was explained, in place of the belt, an intermediate transfer drum may be used. While an example that the cleaning roller 5*g* is used was explained, in place of the roller, other charge member such as a charge blade or a charge brush may be used.

Further, so long as the bias applied to the cleaning roller 5*g* is asymmetrical, other wave forms may be used.

As mentioned above, according to the present invention, since the duty ratio of the alternate voltage applied to the charge means is greater than 50%, the secondary transferring residual toner can be transferred from the intermediate transfer member to the image bearing member effectively.

Further, in the continuous image formation, the throughput of the image formation can be improved.

What is claimed is:

1. An image forming apparatus comprising:

an image bearing member for bearing a toner image formed by a developing means;

an intermediate transfer member having a conductor onto which the toner image on said image bearing member is electrostatically transferred at a first transfer position, the toner image on said intermediate transfer member being electrostatically transferred onto a transfer material at a second transfer position; and a charge means for charging a residual toner remaining on said intermediate transfer member with predetermined polarity by applying an alternate voltage to said charge means after the toner image was transferred from said intermediate transfer member to the transfer material, the residual toner being electrostatically transferred from said intermediate transfer member to said image bearing member at said first transfer position;

wherein a duty ratio of the alternate voltage is greater than 50%.

2. An image forming apparatus according to claim 1, wherein said charge means can be engaged by and disengaged from said intermediate transfer member, and, when the residual toner is charged, said charge means is engaged with said intermediate transfer member.

3. An image forming apparatus according to claim 1, further comprising a voltage apply means for applying voltage to said conductor of said intermediate transfer member, and wherein the residual toner is electrostatically transferred from said intermediate transfer member to said image bearing member at said first transfer position by means of said voltage apply means.

4. An image forming apparatus according to claim 3, wherein said voltage apply means has a roller.

5. An image forming apparatus according to claim 1, wherein the duty ratio of the alternate voltage is 60 to 90%.

6. An image forming apparatus according to claim 5, wherein the duty ratio of the alternate voltage is 70 to 85%.

7. An image forming apparatus according to claim 1, wherein frequency of the alternate voltage is 500 to 5000 Hz.

8. An image forming apparatus according to claim 7, wherein the frequency of the alternate voltage is 1000 to 3000 Hz.

9. An image forming apparatus according to claim 1, wherein peak-to-peak voltage of the alternate voltage is 1000 to 8000V.

10. An image forming apparatus according to claim 9, wherein the peak-to-peak voltage of the alternate voltage is 1500 to 8000V.

11. An image forming apparatus according to claim 1, wherein current flowing through said charge means is 0.5 to 5 mA.

12. An image forming apparatus according to claim 11, wherein the current flowing through said charge means is 1 to 3 mA.

13. An image forming apparatus according to claim 1, wherein a wave form of the alternate voltage is a rectangular wave form.

14. An image forming apparatus according to claim 1, wherein said image bearing member can bear a plural color toner images, and the plural color toner images on said image bearing member are successively transferred onto said intermediate transfer member electrostatically at said first transfer position, and the plural color toner images on said intermediate transfer member are electrostatically transferred onto the transfer material at said second transfer position.

15. An image forming apparatus comprising:

an image bearing member for bearing a toner image formed by a developing means;

an intermediate transfer member having a conductor onto which the toner image on said image bearing member is electrostatically transferred at a first transfer position, the toner image on said intermediate transfer member being electrostatically transferred onto a transfer material at a second transfer position; and a charge means for charging a residual toner remaining on said intermediate transfer member with polarity opposite to normal polarity of toner in said developing means by applying an alternate voltage to said charge means after the toner image was transferred from said intermediate transfer member to the transfer material, the residual toner being electrostatically transferred from said intermediate transfer member to said image bearing member at said first transfer position by a transfer means and at the same time a next toner image on said image bearing member being electrostatically transferred onto said intermediate transfer member at said first transfer position by said transfer means;

wherein a duty ratio of the alternate voltage is greater than 50%.

16. An image forming apparatus according to claim 15, wherein said charge means can be engaged by and disengaged from said intermediate transfer member, and, when the residual toner is charged, said charge means is engaged with said intermediate transfer member.

17. An image forming apparatus according to claim 15, further comprising a voltage apply means for applying voltage to said conductor of said intermediate transfer member, and wherein, at the same time when the residual toner is electrostatically transferred from said intermediate transfer member to said image bearing member at said first transfer position by means of said voltage apply means, the next toner image on said image bearing member is electrostatically transferred onto said intermediate transfer member at said first transfer position.

18. An image forming apparatus according to claim 17, wherein said voltage apply means has a roller.

19. An image forming apparatus according to claim 15, wherein the duty ratio of the alternate voltage is 60 to 90%.

20. An image forming apparatus according to claim 19, wherein the duty ratio of the alternate voltage is 70 to 85%.

21. An image forming apparatus according to claim 15, wherein frequency of the alternate voltage is 500 to 5000 Hz.

22. An image forming apparatus according to claim 21, wherein the frequency of the alternate voltage is 1000 to 3000 Hz.

23. An image forming apparatus according to claim 15, wherein peak-to-peak voltage of the alternate voltage is 1000 to 8000V.

24. An image forming apparatus according to claim 23, wherein the peak-to-peak voltage of the alternate voltage is 1500 to 8000V.

25. An image forming apparatus according to claim 15, wherein current flowing through said charge means is 0.5 to 5 mA.

26. An image forming apparatus according to claim 25, wherein the current flowing through said charge means is 1 to 3 mA.

27. An image forming apparatus according to claim 15, wherein a wave form of the alternate voltage is a rectangular wave form.

28. An image forming apparatus according to claim 15, wherein said image bearing member can bear a plural color toner images, and the plural color toner images on said image bearing member are successively transferred onto said intermediate transfer member electrostatically at said first transfer position, and the plural color toner images on said intermediate transfer member are electrostatically transferred onto the transfer material at said second transfer position.

* * * * *